United States Patent [19]

Wild et al.

[11] 4,112,535

[45] Sep. 12, 1978

[54] HIGH PRESSURE JET WALL CLEANER APPARATUS

[75] Inventors: Robert W. Wild, South Wales; Joseph G. Keeney, Tonawanda, both of N.Y.

[73] Assignee: C. H. Heist Corporation, Clearwater, Fla.

[21] Appl. No.: 697,964

[22] Filed: Jun. 21, 1976

[51] Int. Cl.[2] ..... A47L 11/38

[52] U.S. Cl. ..... 15/98; 134/172; 134/198

[58] Field of Search ..... 15/98, 50 R, 50 C, 302; 134/172, 198, 200, 183

[56] References Cited

U.S. PATENT DOCUMENTS

| | | | |
|---|---|---|---|
| 3,604,049 | 9/1971 | Hetman | 15/302 |
| 3,942,213 | 3/1976 | Hoener, Jr. | 15/302 |

*Primary Examiner*—Edward L. Roberts

*Attorney, Agent, or Firm*—Joseph P. Gastel

[57] ABSTRACT

(1) A wall cleaning unit including a housing with an open side for placement in contiguous relationship to a wall, upper and lower spray bars in the housing for directing high pressure water against the wall, sealing members on the housing around the opening for effecting sealing relationship with the wall, an outlet on the housing for conducting liquid away from the housing, and a high pressure liquid jet arrangement for creating a venturi effect to produce a suction for pressing sealing members against the wall. (2) A system for washing vertical walls including a vehicle mounted for movement along the top of the wall, a boom on the vehicle, a reel on the boom for moving a spray housing vertically on the wall, a source of high pressure water, a second reel on the boom for mounting a hose conducting high pressure water to the spray housing, and a motor on the vehicle for selectively moving the boom to cause the spray housing to move toward and away from the wall. (3) A vehicle for raising and lowering a spray housing including a frame, wheels on the frame for moving the frame in a first direction, a boom mounted on the frame for movement in a direction which is transverse to the direction of movement of the vehicle for moving a spray housing toward and away from a vertical wall, and a reel on the boom for mounting a cable for attachment to the spray housing.

30 Claims, 23 Drawing Figures

Fig. 7.
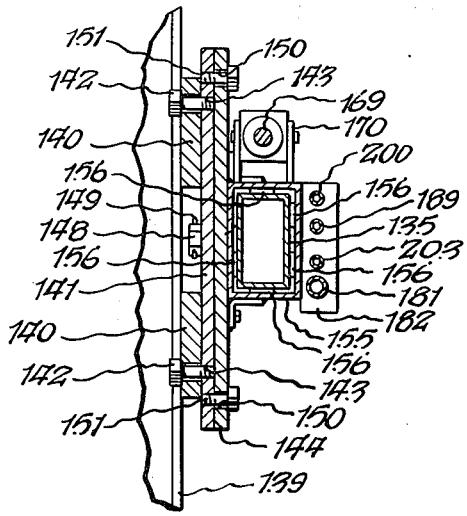
Fig. 8.
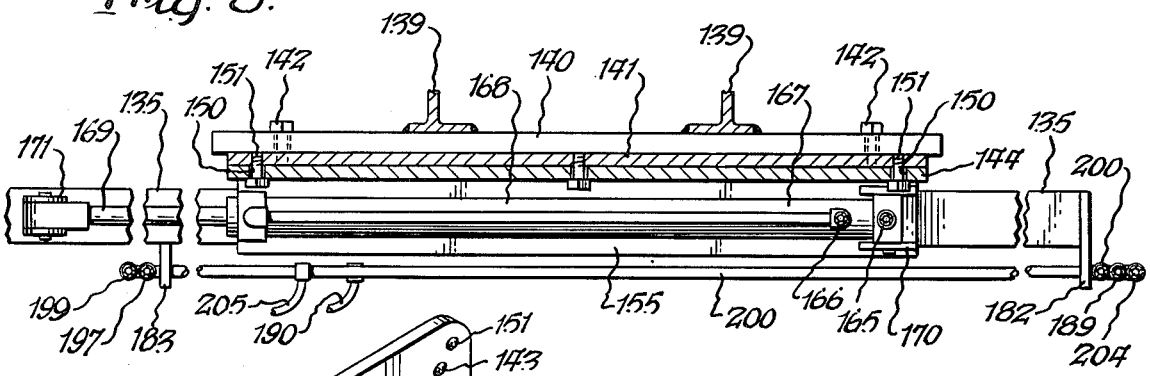
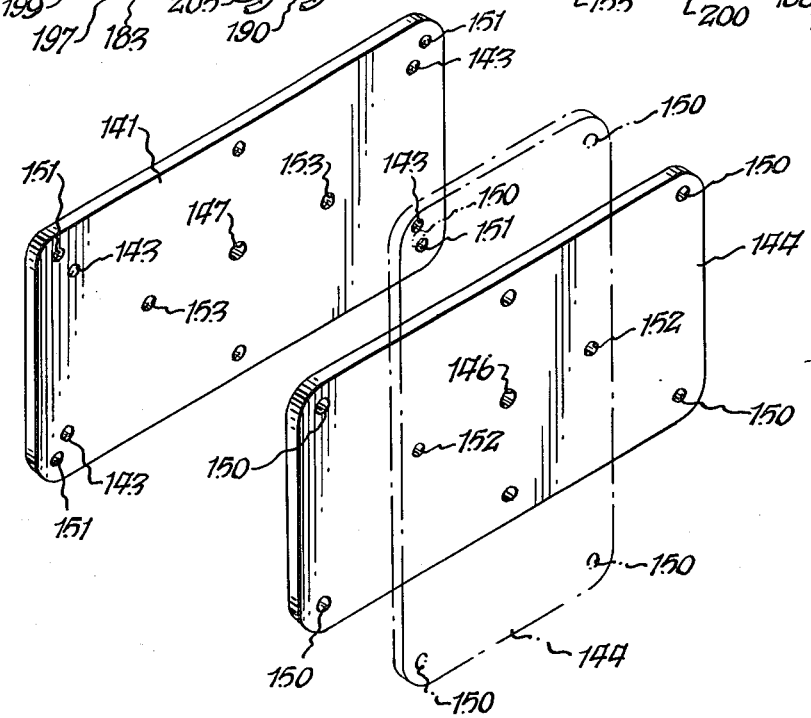
Fig. 9.

Fig. 19.
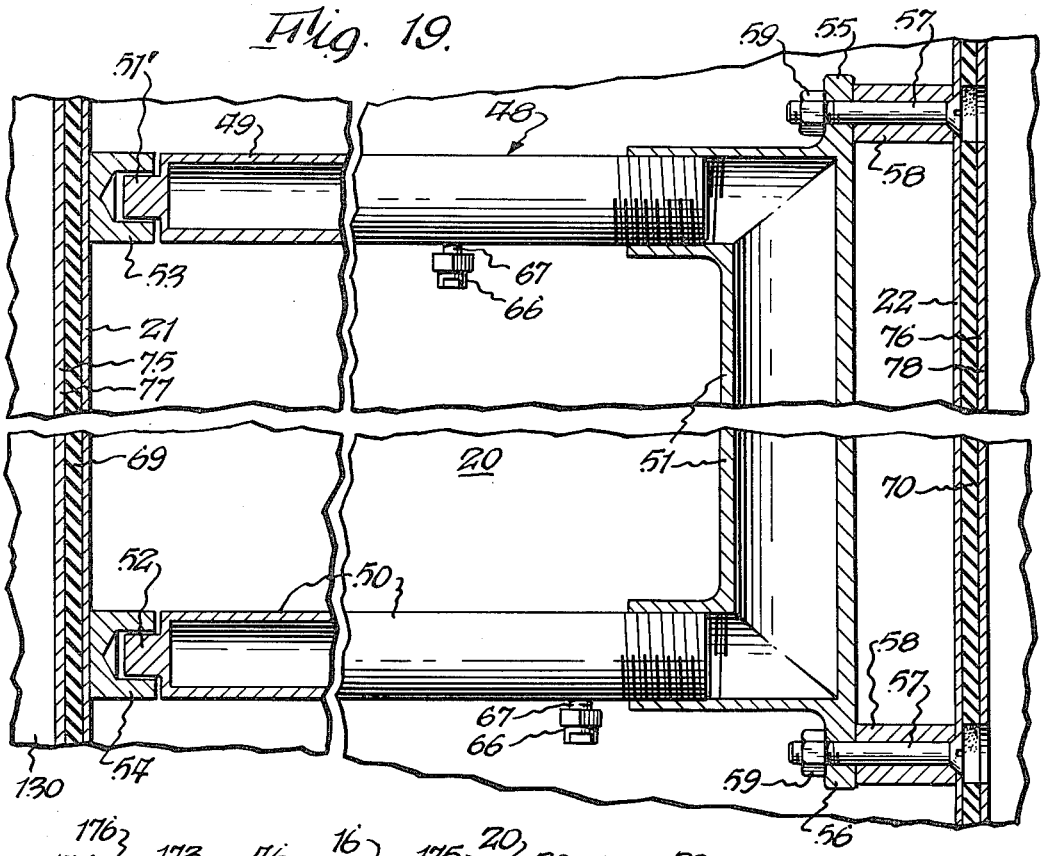
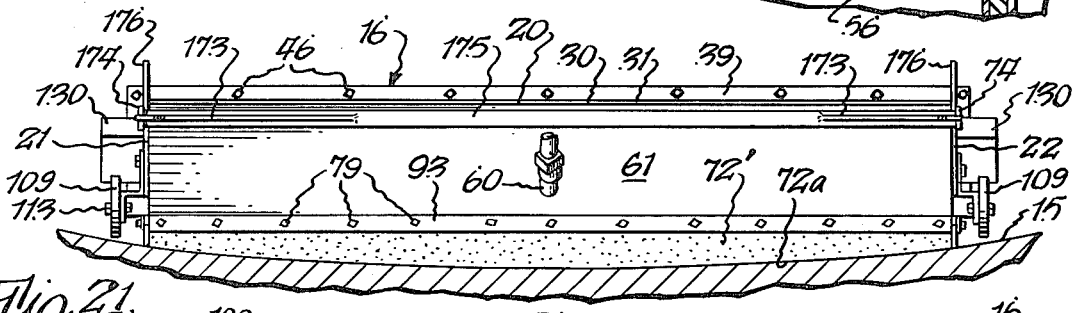
Fig. 21.
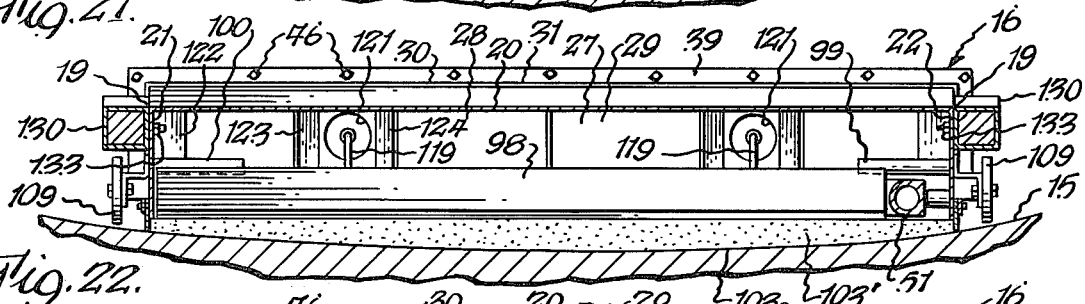
Fig. 22.
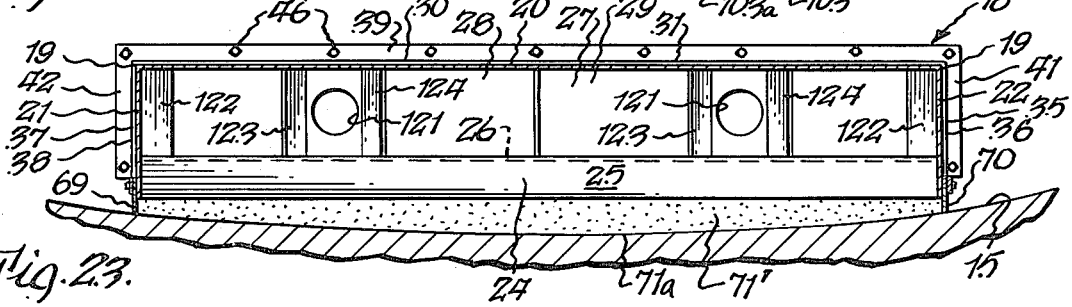
Fig. 23.

HIGH PRESSURE JET WALL CLEANER APPARATUS

The present invention relates to an improved system and apparatus for cleaning a wall by means of high pressure water.

By way of background, the inground tanks associated with nuclear reactors have vertical walls which require periodic cleaning. These walls are contaminated with radioactive materials. In the past, such cleaning was effected by direct manual labor, which was extremely costly and time-consuming. For example, a conventional tank required approximately 300 man hours of labor. In addition, the workers were required to work in direct proximity to the wall and required various means, such as ladders and scaffolds, to reach various portions of the walls which were approximately 25 feet high.

The use of direct jet sprays to clean walls contaminated with radioactive materials was not at all feasible or practical because the turbulent mist produced by the rebound of the sprays contaminated the entire environment in which the tank was located. Therefore, a spray bar, such as shown in U.S. Pat. No. 3,831,848 could not be used for cleaning radioactive contaminated walls. In contrast, the apparatus of the present invention is capable of washing contaminated walls of a nuclear reactor in a highly efficient manner by confining high pressure water sprays and the turbulent mist created thereby within a housing to thereby avoid contamination of the environment.

While U.S. Pat. Nos. 2,581,678, 2,589,020 and 3,118,607 generally disclose housings associated with agricultural sprayers to confine a spray therein, there is no teaching in such patents of the use of high pressure liquid, or of confining high pressure liquid and the mist created thereby within the housing and also providing a drainage arrangement for conducting the spent water and the contaminants contained therein to a remote area for safe disposal.

The present invention relates to a wall cleaning unit comprising a housing, an open side in said housing for placement in contiguous relationship to a wall, means in said housing for projecting high pressure water against the portion of said wall framed by said opening, and means in communication with said housing for conducting water away from said housing.

The present invention also relates to a system for washing vertical walls comprising a spray housing having an open side for positioning in contiguous relationship to a wall, spray means in said housing for spraying water against said wall, a vehicle for movement along the top of said wall, reel means on said vehicle for raising and lowering said spray housing on said wall, and means for supplying high pressure water to said spray means. In its more specific aspect, the means for supplying high pressure water includes a separate motor-pump unit.

The present invention also relates to a vehicle for raising and lowering a spray housing along a vertical wall comprising a frame, wheel means on said frame for moving said frame in a first direction, boom means, means mounting said boom means on said frame for movement in a direction which is transverse to said first direction for moving a spray housing toward and away from said vertical wall, and reel means on said boom means for mounting a cable for attachment to said spray housing.

The various aspects of the present invention will be more fully understood when the following portions of the specification are read in conjunction with the accompanying drawings wherein:

FIG. 7 is a fragmentary cross sectional view taken substantially along line 7—7 of FIG. 3 and showing the bearing arrangement for supporting the boom for axial movement;

FIG. 8 is a fragmentary cross sectional view taken substantially along line 8—8 of FIG. 3 and showing the relationship between the main frame of the vehicle, the boom supporting plates, the boom, and related conduits;

FIG. 9 is a perspective expanded view showing the boom mounting plates in the solid lines which they occupy when the boom is horizontal and in dotted lines which causes the boom to be stowed in a vertical position shown in FIG. 4;

FIG. 19 is an enlarged fragmentary cross sectional view taken substantially along line 19—19 of FIG. 11 with certain parts omitted in the interest of clarity and showing the manner in which the high pressure water manifold is removably mounted on the spray housing;

FIG. 21 is a plan view taken substantially along line 21—21 of FIG. 10 but showing the spray housing mounting a curved wiper for use on the curved wall of the tank;

Figure 10:
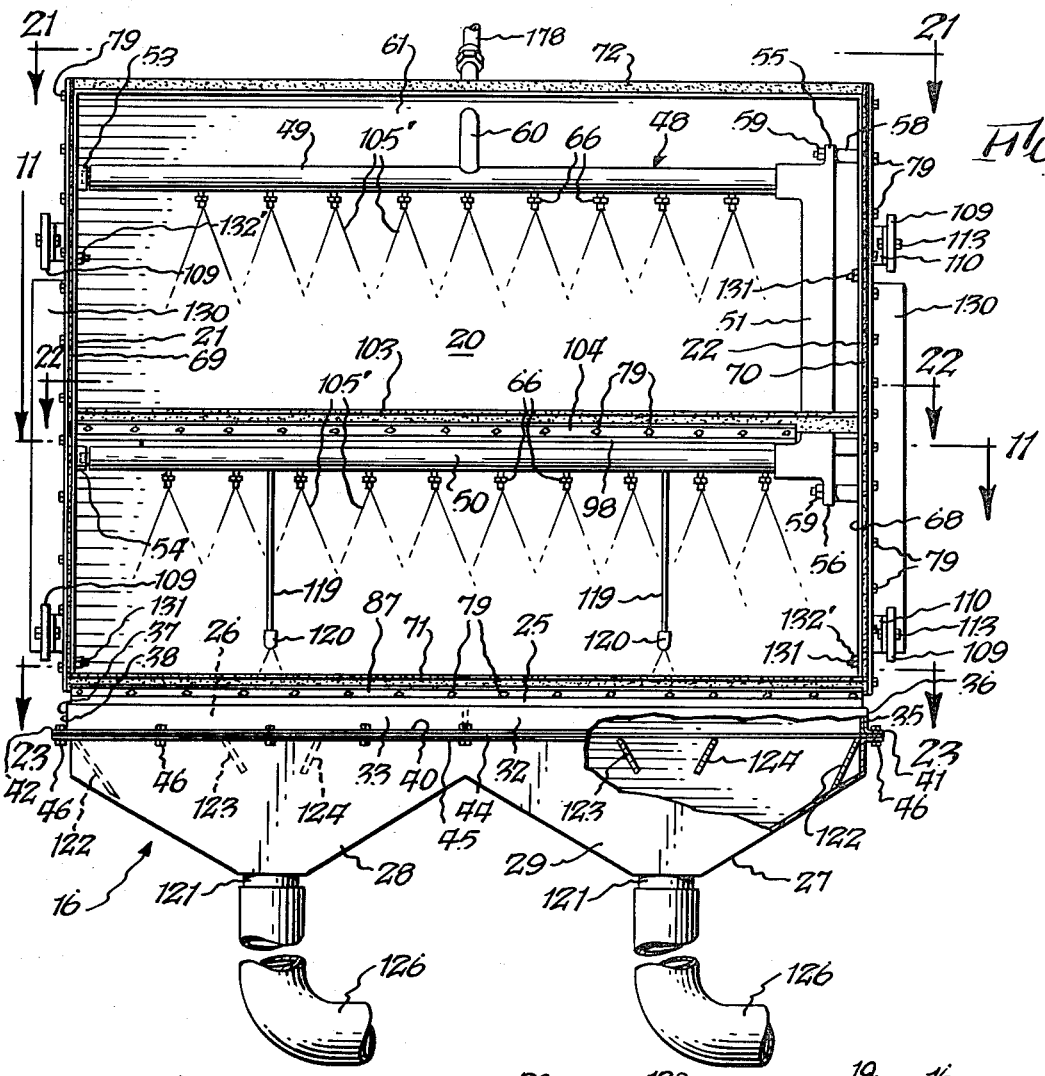
FIG. 10 is a side elevational view taken substantially along line 10—10 of FIG. 3 and showing the various portions of the spray housing as seen from the opening therein which is located against the wall, with certain portions of the housing being broken away.
Figure 11:
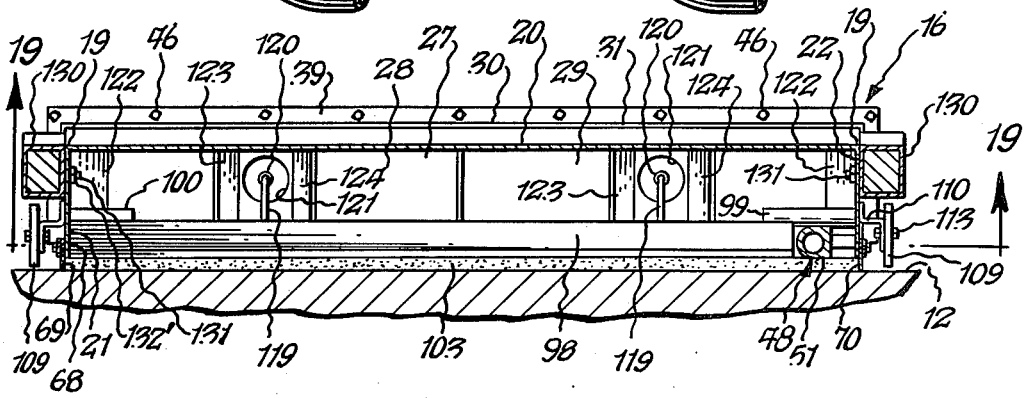
FIG. 11 is a fragmentary cross sectional view taken substantially along line 11—11 of FIG. 10 and showing particularly the relationship between the high pressure water evacuating jets and the conduits for conducting water away from the spray housing.
Figures 13, 14, 15, 16, 17, 18:
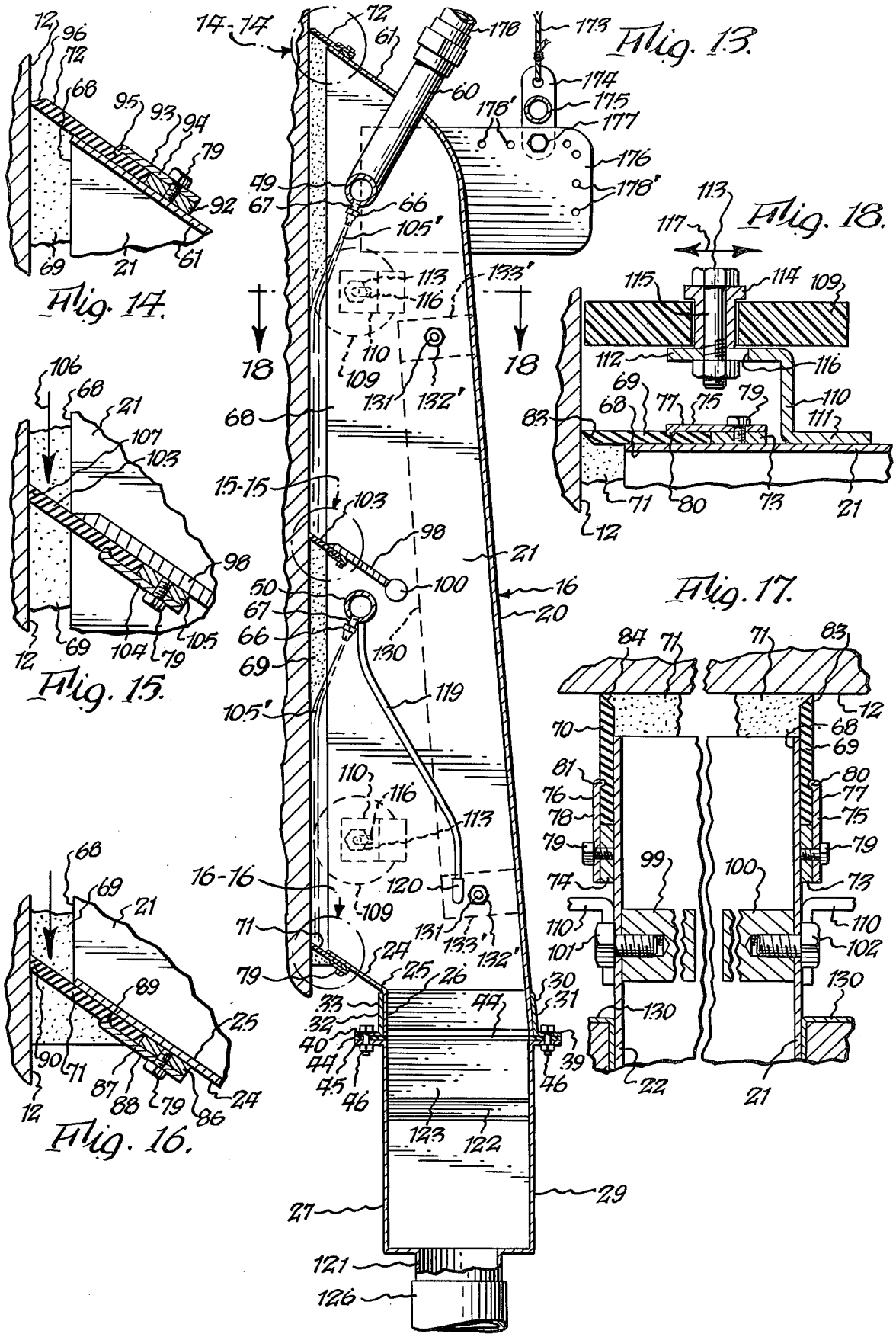
FIG. 13 is a fragmentary cross sectional view taken substantially alongline 13—13 of FIG. 2 and showing further details of the various parts of the housing including the various seals, the wiper, the suspending mechanism, the jets, the conduits for conducting water away, the weights, and the high pressure water evacuating jets.
FIG. 14 is an enlarged fragmentary view of the portion designated 14—14 on FIG. 13 and showing the cross section of the wiper for wiping the wall clean as the spray housing moves downwardly and also showing the structure for mounting the wiper on the housing.
FIG. 15 is an enlarged fragmentary cross sectional view of the circled portion designated 15—15 on FIG. 13 and showing the divider located between the upper and lower rows of jets for preventing water from the upper row of jets from interfering with impingement on the wall of water from the lower row of jets and also showing the structure for mounting the divider on the spray housing.
FIG. 16 is an enlarged cross sectional view of the circled portion designated 16—16 on FIG. 13 and showing the sealing member for sealing the bottom edge of the spray housing relative to the wall and also showing the structure for mounting the sealing member on the housing.
FIG. 17 is a fragmentary cross sectional view taken substantially along line 17—17 of FIG. 2 and showing the structure for mounting the vertical seals on the spray housing and also showing the structure for mounting the divider on the housing.
FIG. 18 is a fragmentary cross sectional view taken substantially along line 18—18 of FIG. 13 and showing the guide wheel structure mounted on the side of the housing for limiting the degree of contact between the vertical sealing member on the edge of the spray housing with the wall of the tank.

FIG. 22 is a view similar to FIG. 11 taken substantially along line 22—22 of FIG. 10 but showing the spray housing mounting a curved divider for replacing the divider shown in FIG. 15 when the housing is used on a curved wall; and FIG. 23 is a view taken substantially along line 23—23 of FIG. 10 and showing a curved bottom sealing member mounted on the spray housing for replacing the straight bottom sealing member such as shown in FIG. 16 when the housing is used in conjunction with a curved wall.

The improved cleaning system 10 of the present invention is for the purpose of cleaning the vertical walls of an inground tank 11 used for housing the components of a nuclear reactor. The tank 11 includes vertical planar walls 12, 13 and 14, and a vertical arcuate wall 15. Walls 12 and 14 are approximately 44 feet long by 25 feet high. Wall 13 is approximately 23 feet long by 25 feet high. Wall 15 is an arc of a cylinder having a radius of about 20 feet and is 25 feet high.

Insofar as pertinent here, the walls 12, 13, 14 and 15 must be cleaned periodically after tank 11 has been drained. However, the walls have a radioactive deposit thereon. As noted previously, in the past the walls were cleaned manually and required approximately 300 man hours of labor. Spraying of the walls with high pressure hoses to clean them was not feasible because the spray could create a radioactive mist which could enter the air and contaminate everything in the building in which the tank 11 was housed.

The improved cleaning system 10 of the present invention is capable of cleaning the tank 11 in a relatively short period of time by the use of high pressure water sprays without allowing the radioactive mist which is created to contaminate the atmosphere. Broadly, and by way of preview, the improved cleaning system 10 includes a spray housing 16 which is lowered along the walls of tank 11, from top to bottom, and contains high pressure spray jets which clean the walls thoroughly. The housing 16 includes structure for causing it to remain in sealed engagement with the walls while it is being lowered to thereby confine the turbulent mist which is created. During cleaning the spray housing 16 is lowered downwardly along a wall in parallel swaths by structure associated with vehicle 17. After the cleaning of each swath has been completed, the housing is moved away from the wall and raised to the top of the wall. Thereafter, vehicle 17 is moved along the top of the wall an increment less than the width of the housing and the spray housing 16 is again moved into engagement with the wall. Thereafter, housing 16 is lowered to clean another adjacent vertical swath on the walls, and the foregoing steps are repeated. The high pressure water is supplied to housing 16 by a motor-pump unit 18 which is selectively connected to housing 16.

Spray housing 16 includes a continuous rear wall 20 and a pair of mirror-image side walls 21 and 22 attached thereto, as by welding, in fluid-tight relationship (FIGS. 10, 11, 13, 17 and 19) along vertical edges 19. An elongated plate member 24 (FIGS. 13 and 23) has an upper planar portion 25 and a lower vertical planar portion 26 depending downwardly therefrom. The opposite ends of portions 25 and 26 are welded to sides 21 and 22. All metal parts of the spray housing are fabricated from highly polished stainless steel as this can be decontaminated readily.

Figure 2:
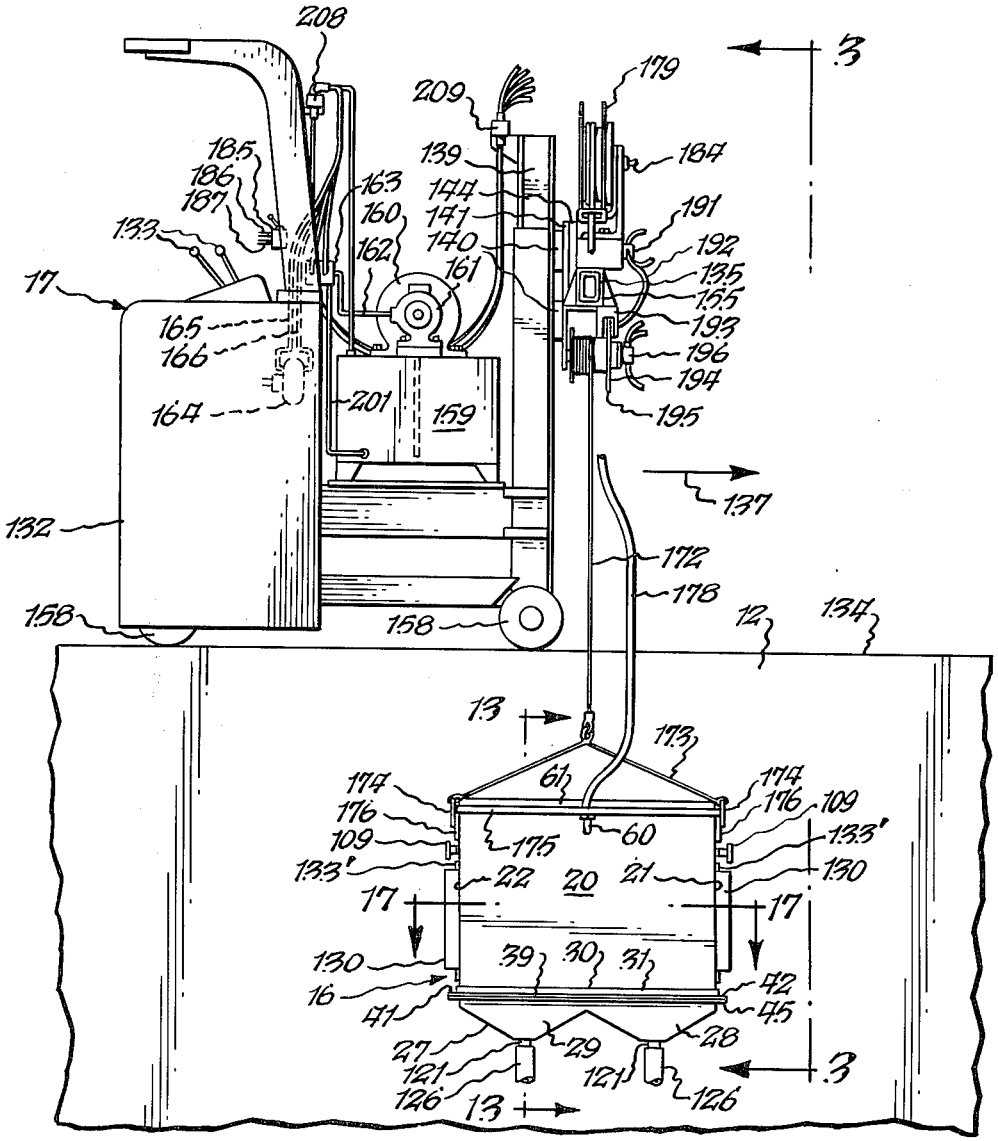
FIG. 2 is a fragmentary view taken substantially in the direction of arrows 2—2 of FIG. 1 and showing both the spray housing and its supporting vehicle in side elevation.

A water outlet housing portion 27 (FIGS. 10 and 13) consisting of two funnel-shaped portions 28 and 29 is located at the lower portion of spray housing 16. In this respect, the vertical leg 30 of an angle member 31 is welded across the entire width of the lower portion of back 20 of housing 16 (FIGS. 2, 11 and 13). An angle member 32 has its vertical leg 33 welded across the entire length of portion 26 of member 24 (FIGS. 10 and 13). An angle member 35 (FIG. 10) has its vertical leg 36 welded across the entire width of the lower portion of side 22 and an angle member 37 has its vertical leg 38 welded across the entire width of the lower portion of side 21 (FIGS. 10 and 23). The horizontal legs 39, 40, 41 and 42 of angles 31, 32, 35 and 37, respectively, lie in the same horizontal plane. A rectangular gasket 44 is located in contiguous relationship with the undersides of horizontal legs 39, 40, 41 and 42 and the horizontal rectangular flange 45 of housing 27 is placed in abutting relationship to gasket 44 (FIGS. 10 and 13). Nut and bolt assemblies 46 assemble housing portion 27 to the back 20, sides 21 and 22, and portion 24 of the housing in fluid-tight relationship.

A highly polished stainless steel manifold 48 is removably mounted within housing 16 (FIGS. 10, 13 and 19). Manifold 48 includes upper horizontal conduit 49 and lower horizontal conduit 50 which are in communication with each other through vertical conduit 51 into which they are threaded. Bosses 51' and 52 at the ends of conduits 49 and 50, respectively, are slidably and removably received in mating receptacles 53 and 54, respectively, welded on wall 21. Bosses 55 and 56 at the upper and lower ends, respectively, of conduit 51 receive bolts 57 which extend through side wall 22 and spacers 58 and are secured by nuts 59 to retain manifold 48 in position within housing 16. Manifold 48 is mounted in position by slipping bosses 51 and 52 into receptacles 53 and 54, respectively, and thereafter attaching bosses 55 and 56 to wall 22 by means of nut and bolt assemblies 57-59. Because of the foregoing attaching structure, manifold 48 may be selectively removed from housing 16 to permit thorough cleaning thereof for purposes of decontamination.

High pressure water is supplied to manifold 48 through conduit 60 which is in communication with conduit 49. Conduit 60 extends through an aperture in upper portion 61 of wall 20 and is connected to a suitable high pressure water source which is capable of providing approximately 20 gallons per minute at between about 2,000 and 3,000 pounds per square inch pressure. In this respect, the high pressure water source is an independent motor-pump unit 18 consisting of electric motor 62 coupled to pump 63 having a fluid end 64 attached thereto, the latter being connected to a suitable source of water through conduit 64'. High pressure water from unit 18 is selectively supplied to manifold 48 as will be described in detail hereafter.

Figure 12:
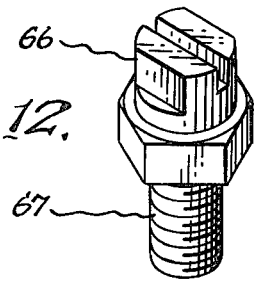
FIG. 12 is an enlarged perspective view of the type of jet nozzle mounted in the housing.

A plurality of jet nozzles 66 (FIG. 10) have threaded shank portions 67 (FIG. 12) which screw into conduits 49 and 50. Each of the nozzles is capable of providing a fan-shaped jet. It is to be noted that the nozzles 66 in upper conduit 49 are staggered with respect to the nozzles in lower conduit 50 (FIGS. 10 and 19) so that streaking of the wall will be eliminated.

A continuous seal is provided around the entire opening 68 in the housing defined by the free edges of side walls 21 and 22, top portion 61 of back 20, and plate portion 25. Opening 68 is located in contiguous relationship to the wall being cleaned. In the foregoing respect, rubber or plastic sealing strips 69 and 70 are attached to side walls 21 and 22, respectively (FIG. 17). Bottom sealing strip 71 (FIGS. 13, 16 and 17) is attached to upper portion 25 of plate 24. An upper combined wiper and seal 72 is attached to upper portion 61 of housing back 20 (FIGS. 10, 13 and 14). All of the sealing strips 69, 70, 71 and 72 are attached to the housing in an identical manner. In this respect, metal strips 73 and 74 (FIG. 17) are welded along the entire length of side walls 21 and 22. Clamping plates 75 and 76 have planar portions 77 and 78, respectively, which are attached to strips 73 and 74, respectively, by means of screws 79. The ends 80 and 81 of plates 75 and 76 are formed into flanges which extend the entire length of strips 77 and 78 for pressing into seal members 69 and 70, respectively, to hold them firmly in position against the outside portions of walls 21 and 22. The ends 83 and 84 of seal members 69 and 70, respectively, are tapered (FIG. 17) so as to provide good sealing edges with wall 12.

A metal strip 86 is welded to the underside of plate member 24 along the entire length thereof from wall 21 to wall 22 (FIGS. 13, 16 and 17). A clamping strip 87 has a portion 88 which is held against strip 86 by means of spaced screws 79, and at the end of member 87 there is a flange 89 which presses against sealing strip 71. Clamping member 87 extends substantially the entire distance from side wall 21 to side wall 22, as does strip 86. The end of sealing strip 71 is tapered at 90 to provide good contact with wall 12. An elongated strip 92 is welded across the top 61 of back 20 and this strip extends substantially the entire distance between side wall 21 and side wall 22. A clamping strip 93 (FIGS. 14 and 21) has portion 94 thereof secured to strip 92 by spaced screws 79. A flange 95 extending inwardly from portion 94 engages sealing-wiper strip 72 and holds it in position against portion 61 of the housing. The end 96 of sealer-wiper 72 is tapered for the purpose of causing it to contact wall 12 with a good sealing and wiping action. As noted briefly above, in use, housing 16 is lowered downwardly along the walls with which it is in engagement. As it moves downwardly, the tip 96 of sealer-wiper 72 will wipe the wall clean after the wall has been sprayed.

An elongated metal plate 98 extends substantially the entire distance between walls 21 and 22 (FIGS. 10, 13 and 22). Plate 98 includes bosses 99 and 100 at opposite ends thereof (FIG. 17). Boss 99 is secured to wall 22 by means of screw 101 and boss 100 is secured to wall 21 by screw 102. Strip 98 can be pivoted to any desired angular position, for example, the position shown in FIG. 13, and thereafter screws 101 and 102 are tightened to retain it in this position. A sealing strip 103 is secured to the underside of strip 98 by means of clamping strip 104 which extends substantially the entire distance between side walls 21 and 22. Clamping strip 104 is secured by means of screws 79 to strip 105 which is welded to the underside of metal strip 98. Sealing strip 103 serves the function of preventing the high pressure jets 105' emanating from upper manifold conduit 49 from interfering with impingement on the wall of the jets emanating from lower manifold conduit 50. In this respect, sealing member 103 acts as a barrier to prevent the water traveling in the direction of arrow 106 (FIG. 15) from providing a film on wall 12 in the area at which the jets emanating from manifold conduit 50 impinge on the wall. The end 107 of sealing member 103 is tapered, as shown in FIG. 15, to cause it to have the required flexibility. At this point it is to be noted that all of the sealing members 69, 70, 71, 72 and 103 are fabricated from flexible rubber or suitable flexible plastic to enable them to have the necessary sealing contact with the wall which they engage.

At this point it is also to be noted that the attaching strips, such as 93, 104, 87, 75 and 76, which secure their respective sealing strips to the housing, allow for the adjustment of such sealing strips relative to the housing. In this respect, by loosening the screws holding these strips, the positions of the sealing strips themselves may be adjusted to the proper position relative to the portions of the housing on which they are mounted, and thereafter the holding strips enumerated above may be tightened into clamping position by manipulating screws 79.

In order to set the degree of contact between the various sealing strips with wall 12, wheels 109 (FIGS. 10, 11 and 18) are mounted on side walls 21 and 22. In this respect, two wheels 109 are mounted on side wall 21 and two wheels 109 are mounted on side wall 22. The mounting of each of the wheels is by means of a Z-shaped bracket 110 having one leg 111 welded to a wall, such as 21, and another leg 112 mounting a nut and bolt assembly 113 which carries a bearing member 114 on which wheel 109 is rotatably supported. As can be seen from FIG. 18, the shank 115 of bolt 113 extends through an elongated slot 116 in bracket portion 112. Therefore it can be moved back and forth in the direction of arrow 117 to adjust the position of wheel 109 relative to the walls, such as 21, on which it is mounted. By means of this adjustment, the outer periphery of the wheel 109 can be located relative to the tip such as 83 of sealing member 69 so that the position of wheel 109 will determine the degree of contact that the sealing member makes with the wall 12. It will readily be appreciated that by the proper adjustment of all four wheels 109, the degree of contact of all of the sealing members with wall 12 will be determined. Furthermore, while only one wheel 109 has been described in FIG. 18 relative to its mounting structure, it will be appreciated that all of the wheels 109 are mounted in an analogous manner.

In order to confine the mist within housing 16, it is necessary to insure that the various sealing strips maintain tight engagement with wall 12. It will be appreciated that since the jets 105' (FIG. 13) impinge against the wall, the reactive force could cause housing 16 to move away from the wall, especially considering the high pressure, namely, between 2,000 and 3,000 psi, and high volume, approximately 20 gallons per minute, which is experienced. Therefore, in order to cause the housing 16 to be drawn toward the wall, the chamber produced by housing 16 is evacuated in an unique manner to cause the air pressure on the outside thereof to force it toward the wall and thereby maintain excellent sealing engagement therewith at the edges of the sealing members. In order to evacuate housing 16, two jets are provided. In this respect, conduits 119 (FIGS. 10, 11 and 13) are in communication with lower manifold conduit 50. The nozzle ends 120 of conduits 119 are in direct alignment with conduits 121 at the lower ends of water outlet housing 27. The jets emanating from conduits 119 will be on the centerline of conduits 121. In addition, funnel-like members 28 and 29 include inclined rectangular plates 122, 123 and 124 therein (FIGS. 10, 11 and 23) for directing flow toward the respective conduits or nipples 121 with which they are associated. The high-pressure relatively high-volume flow through conduits 119 in conjunction with the baffles 122, 123 and 124 will create a venturi effect which causes rapid evacuation of the liquid in funnel-like members 28 and 29, and this rapid evacuation will in turn tend to cause a low pressure area within housing 16 which in turn causes the air pressure on the outside of housing 16 to force it against wall 12. Thus, the mist within housing 16 cannot escape into the environment. The water which leaves housing 16 via nipples 121 is conducted through relatively long flexible conduits 126 mounted on nipples 121 to the bottom of tank 11 where suitable drain outlets are located. It will be appreciated that by virtue of the flow of the water through relatively long conduits 126, the mist which originally existed within housing 16 is consolidated into streams of water which will not enter the air to contaminate it, as would be the case with mist.

Weights are mounted on housing 16 for causing it to move downwardly along the walls during the cleaning process. The weights are for a dual purpose. The first purpose is for overcoming the resistance to downward movement of housing 16 due to the upward pull thereon by the reel 179 through hose 178, as described more fully hereafter. The second purpose is for overcoming the suction effect described above which would tend to cause the housing to adhere to the walls. The weights are in the form of solid rectangular totally enclosed boxes 130 having an outer shell of highly polished stainless steel and filled with lead. Bolts 131 (FIG. 13) extend through ears 133' at the ends of member 130 and extend through suitably spaced apertures (not numbered) in each side wall 21 and 22. Nuts 132' screw onto bolt portions 131 within the housing to retain weights 130 in position.

As noted briefly above, the housing 16 is caused to move downwardly along each wall, such as 12, to produce vertical slightly overlapping swaths. In order to achieve this, vehicle 17 is used. Essentially, vehicle 17 is a modified fork lift which is driven by an operator who stands on a platform at the rear of the vehicle at 132 and manipulates controls such as 133. The vehicle 17 is driven on horizontal edge portion 134 (FIG. 3) of tank 11 and parallel to the wall being cleaned. The operator drives vehicle 17 to a given position and lowers the jet housing 16 downwardly along each wall from the top of the tank to the bottom by actuating winch or reel 195. After housing 16 reaches the bottom of the tank, the operator causes boom 135 to move horizontally to cause the spray housing 16 to be pulled away from the wall in the direction of arrow 136 (FIG. 3), and he thereafter lifts housing 16 to the top of the tank by actuating reel 195. Thereafter, he advances vehicle 17 along edge 134 in the direction of arrow 137 (FIG. 2) an amount which is slightly less than the width of spray housing 16, and he thereafter moves boom 135 in the direction of arrow 138 (FIG. 3) until the housing 16 moves into engagement with wall 12. Thereafter, he actuates winch 195 to cause housing 16 to move downwardly from the top of the tank to the bottom thereof to clean another vertical swath in the tank. The foregoing procedure is repeated in increments until the entire tank is cleaned. It will be appreciated that the high pressure water is supplied to manifold 48 only when housing 16 is in engagement with the wall. The high pressure water is shut off before the housing 16 is drawn away from wall 12, that is, before it is lifted from the bottom of the tank to the top thereof during the process of resetting it to clean a swath next to the swath which has already been cleaned.

Vehicle 17 includes spaced frame members 139 (FIGS. 7 and 8) which have horizontal bars 140 secured thereto as by welding. Frame members 139 are moved up and down by means of a suitable drive arrangement on the vehicle consisting of a piston 139' and cylinder 138'. A first plate member 141 (FIGS. 7, 8 and 9) is attached to horizontal plate members 140 welded to frame members 139 by means of screws 142 which are received in tapped holes 143. An outer plate 144 includes a stud 145 having an end portion welded in central hole 146 with the stud extending through a hole 147 in plate 141 and mounting a nut 148 on the outer end thereof, the nut being held in position by means of a cotter pin 149. Because of the foregoing mode of mounting, plate 144 can be pivoted from its normal operative position shown in solid lines in FIG. 9 to a dotted line position shown in this figure. The dotted line position of FIG. 9 is shown in solid lines in FIG. 4 and it is used when the equipment is to be stored, as will become more apparent hereafter. However, during normal operation, plate 144 assumes the position shown in FIG. 3. When in the FIG. 3 position, bolts are inserted through holes 150 in plate 144 and are received in tapped apertures 151 in plate 141. This will hold boom 135 and its supporting mechanism in a horizontal position. However, when it is desired to move plate 144 to the position shown in FIG. 4, the bolts are removed from apertures 150 and 151 and the plate 144 is swung to a dotted line position and bolts are inserted through apertures 152 which are in alignment with tapped apertures 153 when plate 144 is in the dotted line position shown in FIG. 9. The foregoing plate structure 141–144 is for holding boom 135 in a horizontal position in use and for moving it to the vertical position shown in FIG. 4 for storage. Furthermore, plates 141–144 may be lifted while the boom 135 is in a horizontal position, as may be required to lift housing 16 over fence 134'.

Figure 5:
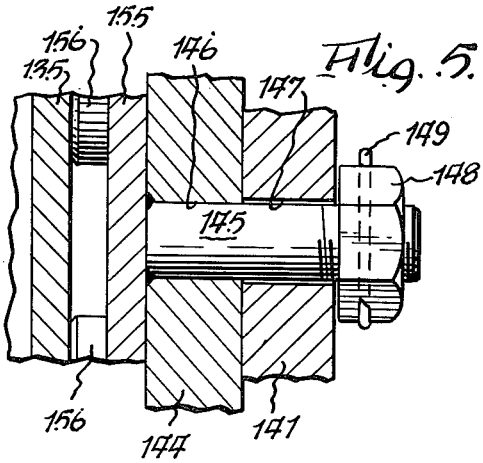
FIG. 5 is a fragmentary cross sectional view taken substantially along line 5—5 of FIG. 3 and showing the relationship between the boom mounting plates and the pivot pin associated therewith.

As noted briefly above, boom 135 is mounted for horizontal reciprocatory movement for moving housing 16 toward and away from the tank wall, as required. In this respect, boom 135 is mounted in sleeve 155 which is suitably bolted to the face of plate 144. Sleeve 155 includes a plurality of bearing members 156 (FIGS. 5 and 7) at each opposite end thereof for supporting boom 135 for reciprocatory sliding movement. One series of bearing members are located along line 7—7 of FIG. 3 and another series of bearing members are located in an analogous position at the opposite end of sleeve 155.

Figure 6:
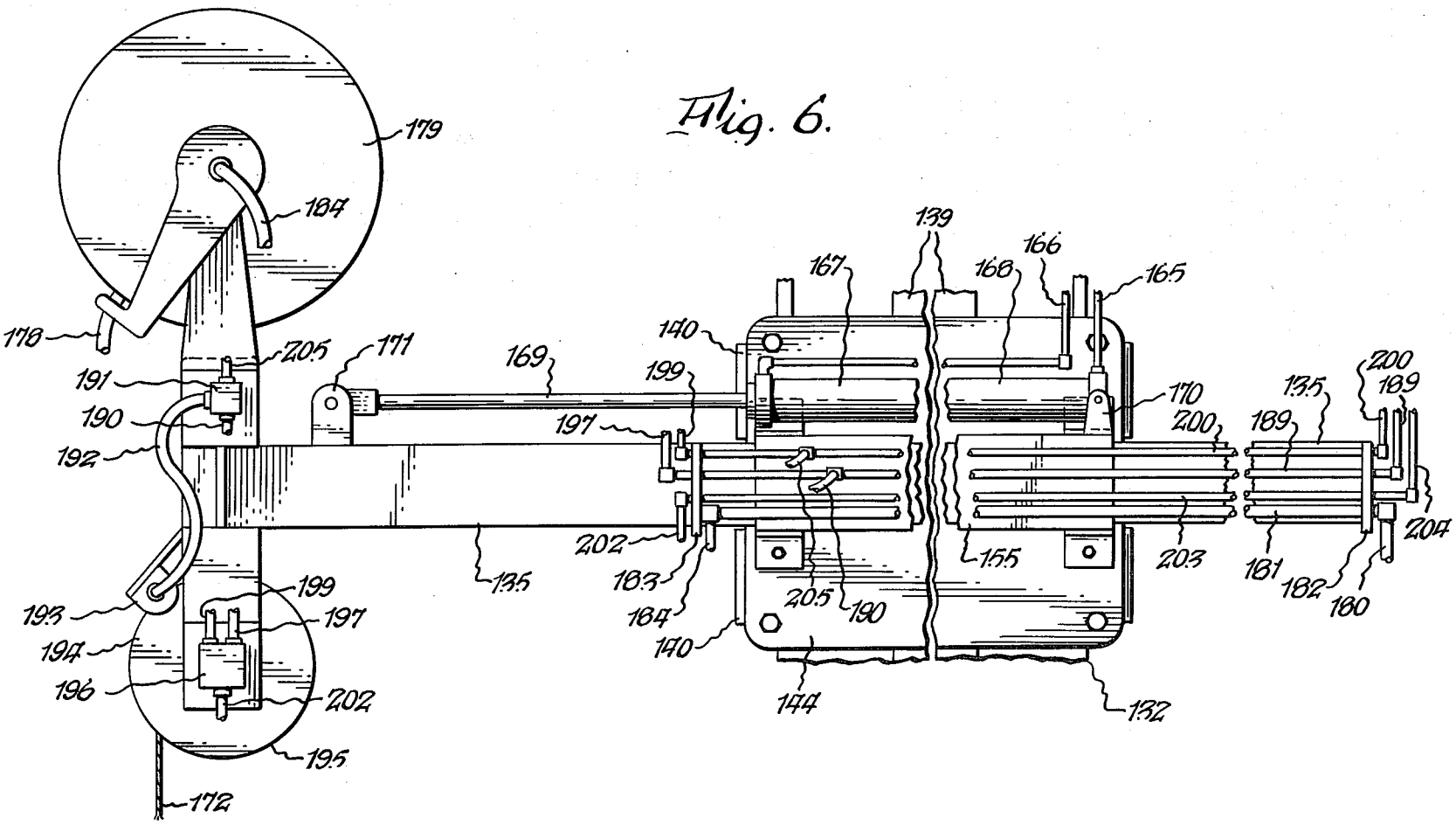
FIG. 6 is a fragmentary enlarged end elevational view of the boom portion of the supporting vehicle and its associated mechanism.
Figure 20:
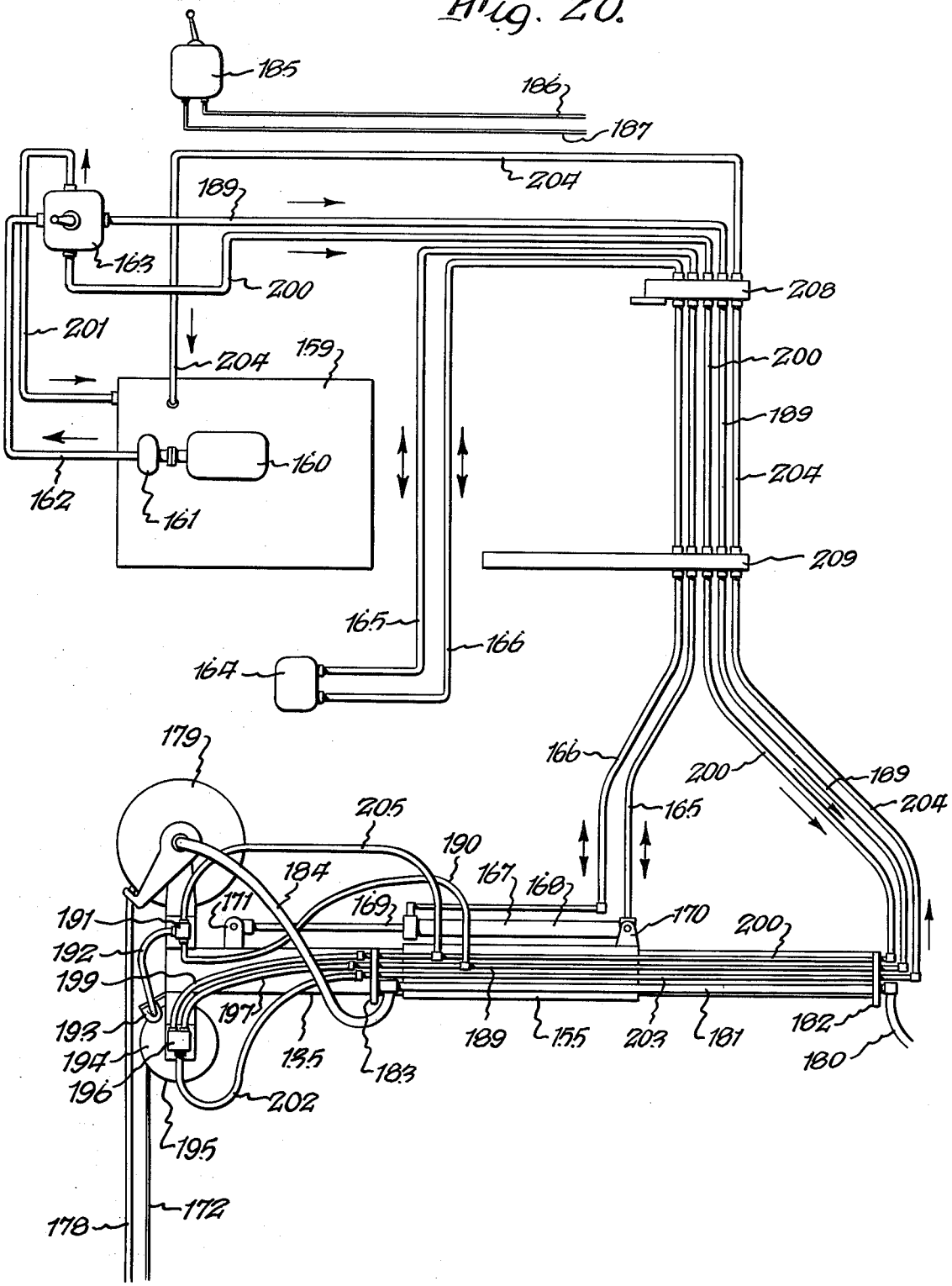
FIG. 20 is a schematic hydraulic diagram showing the various hydraulic conduits associated with the boom for operating the various components mounted thereon.

As noted briefly above, vehicle 17 is driven in increments along the border 134 of tank 11. To this end it has a suitable driving mechanism and is mounted on wheels 158. The vehicle 17 carries an hydraulic fluid tank 159. An electric motor 160 mounted on the top of tank 159 drives pump 161 which pumps hydraulic fluid through conduit 162 to valve 163. Motor 160 is energized from an external electric source because of its large electrical requirements. In addition, a separate pump 164 driven by an electric motor is selectively energized to conduct hydraulic fluid through conduits 165 and 166 to piston and cylinder type of hydraulic motor 167. A suitable reservoir (not shown) is associated with pump 164. Because pump 164 is used sparingly, the motor which drives it is energized by the vehicle battery. Motor 167 includes a cylinder 168 and a piston 169. The end of cylinder 168 is pivotally mounted on clevis 170 which is secured at one end of sleeve 155. The end of piston 169 remote from clevis 170 is affixed to clevis 171 which is rigidly secured to boom 135. Thus, when high pressure hydraulic fluid is supplied to conduit 165, piston 169 will be moved to the left in FIGS. 6 and 20 and thus cause boom 135 to move to the left. The exhaust hydraulic fluid will travel through conduit 166 back to tank 159. High pressure fluid is supplied to conduit 165 when it is desired to move boom 135 to the left in FIG. 3 to cause the spray housing 16 to be moved away from the wall.

It is to be noted that housing 16 is suspended by means of cable 172 which in turn is attached to cable 173 having its opposite ends attached to tabs 174 located at the opposite ends of spreader bar 175. Tabs 174 are secured to tabs 176 welded to the outsides of side walls 21 and 22. To adjust the angle at which housing 16 hangs, tabs 174 may be secured at any desired location on tabs 176 by nut and bolt assemblies 177 which can fit through tabs 174 and any of the apertures 178' in tabs 176. Whenever flow through conduits 165 and 166 is reversed so that high pressure fluid travels through conduit 166, piston 169 will move to the right in FIGS. 6 and 20 to move boom 135 to the right, and exhaust hydraulic fluid will pass through conduit 165 away from cylinder 168. It is by the actuation of motor 167 in opposite directions that spray housing 16 can be moved toward and away from the wall such as 12.

High pressure water is supplied to conduit 60, which is in communication with manifold 48, through hose 178 which is wound on reel 179. High pressure water is supplied to reel 179 through conduit 180 leading from the high pressure outlet of fluid end 64 of pump 63. Conduit 180 is in communication with conduit 181 mounted on brackets 182 and 183 secured to boom 135. Flexible conduit 184 effects the communication between conduit 181 and reel 179. An air-operated control valve 185 (FIG. 20) supplies air through conduits 186 and 187 to a suitable control on pumping unit 18, as required. By the manipulation of control 185 the vehicle operator supplies air in the proper direction to pumping unit 18 and thus either causes the pumping unit to supply high pressure water through conduit 180 or not to do so. As noted above, the only time that high pressure water is supplied is when the spray housing 16 is against the wall. Before it is pulled away from the wall, the flow of high pressure water through conduit 180 is terminated.

Cable 172, which supports spray housing 16, and high pressure water hose 178, which is connected to spray housing 16, are raised and lowered simultaneously. In this respect, when it is desired to lower spray housing 16, valve 163 is positioned so as to cause high pressure hydraulic fluid to flow from pump 161 through conduit 189, and conduit 190 in communication therewith leading to coupling 191 which is in communication with conduit 192 leading to disc brake 193 which clamps onto disc 194 associated with reel 195 on which cable 172 is wound. The existence of high pressure fluid in brake 193 will release it. Simultaneously high pressure fluid will be supplied to a motor 196 associated with reel 194 through conduit 197 which is in communication with high pressure conduit 189. Exhaust flow from motor 196 will pass into conduit 202 and thence into conduit 203 and conduit 204 which leads back to tank 159. In addition, since pump 161 is of the constant volume type, any excess flow therefrom will pass into conduit 201 which is in communication with tank 159. Whenever hydraulic fluid does not flow in conduit 189, disc brake 193 will automatically clamp onto disc 194 to hold it in position.

If it is desired to rotate reel 195 to raise cable 172, it is merely necessary to set valve 163 so that high pressure hydraulic fluid flows through conduit 200. In this situation high pressure hydraulic fluid will be supplied to motor 196 via conduit 199 and the return to the sump will be via conduits 202, 203 and 204. In addition, the brake 193 will be released because high pressure fluid will be supplied thereto via conduit 200, conduit 205, coupling 191, and conduit 192. Return line 201 will always cause excess flow from pump 161 to return to the sump.

It will be appreciated that it is not necessary to supply hydraulic fluid to hose-carrying reel 179, as it will automatically permit the hose to unwind as spray housing 16 is lowered and a spring mechanism associated with reel 179 will cause it to automatically wind the high pressure hose thereon as spray housing 16 is raised by reel 195. As noted briefly above, weights 130 on housing 16 will counteract the force of the spring mechanism tending to raise hose 178 connected between reel 179 and spray housing 16.

Figure 4:
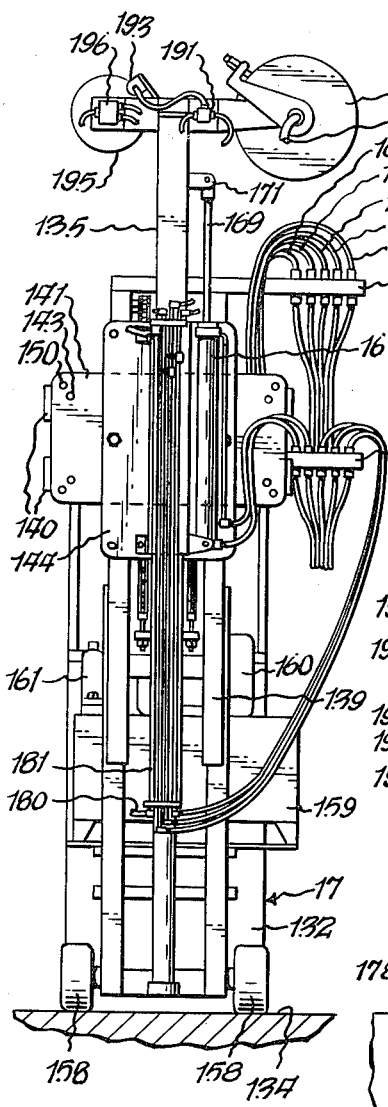
FIG. 4 is a view of the supporting vehicle in end elevation but with the spray housing carrying boom in stowed vertical position.
Figure 3:
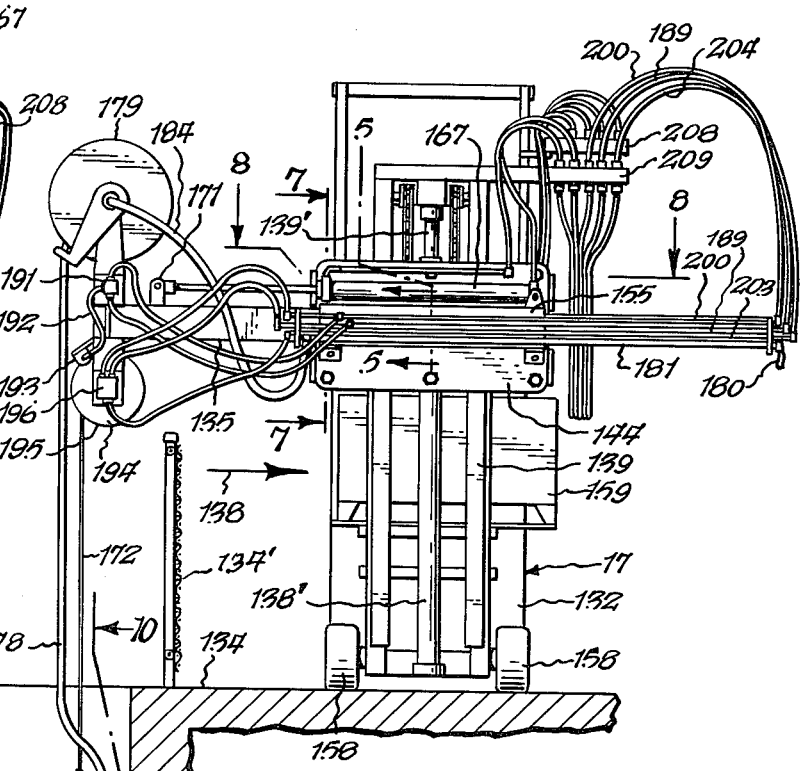
FIG. 3 is a fragmentary view partially in cross section and taken substantially along line 3—3 of FIG. 2 and showing both the spray housing and the supporting vehicle in end elevation.
Figure 3:
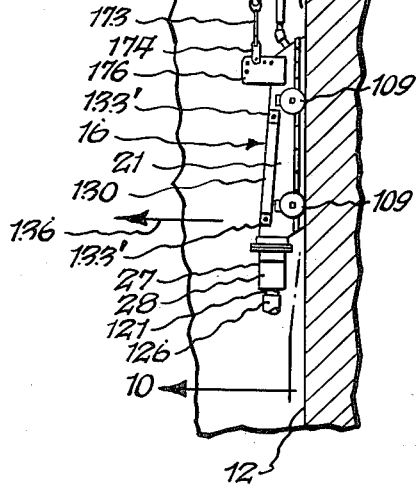

As can be seen from FIGS. 2, 3 and 4, brackets 208 and 209, which are mounted on the frame of the vehicle 17, support the flexible hoses leading to boom 135. In this respect, all the hoses leading to and from each of brackets 208 and 209 are flexible, and the flexible hoses terminate at rigid pipe conduits mounted on boom 135 by brackets 182 and 183.

Figure 1:
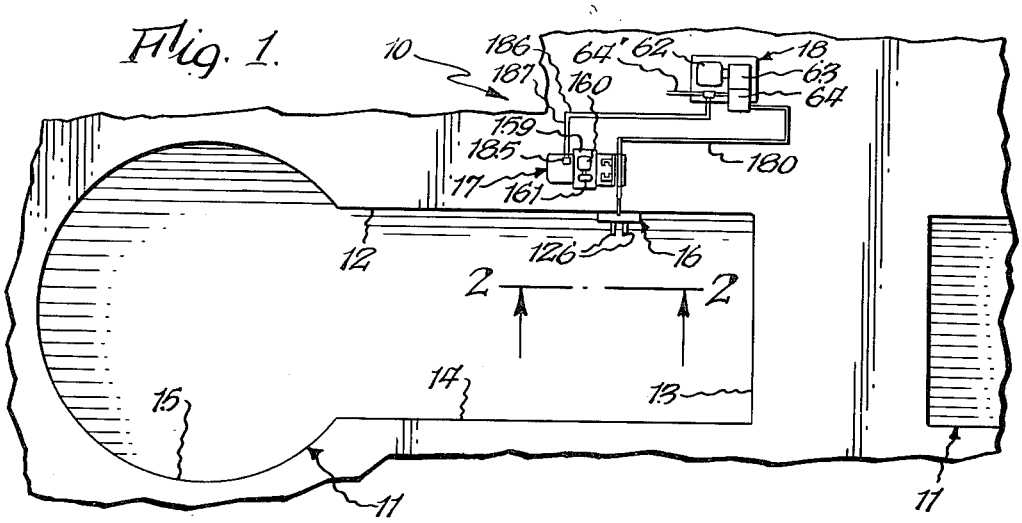
FIG. 1 is a fragmentary schematic plan view of the improved wall cleaning system of the present invention located in position proximate the wall of a nuclear reactor tank.

In FIGS. 21, 22 and 23 sealing members are disclosed for use when spray housing 16 is used to clean the curved wall 15 of FIG. 1. In this respect, the sealing members 72, 103, and 71 of FIGS. 14, 15 and 16, respectively, are removed from the housing by loosening the retaining plates associated therewith. Sealing members 72', 103' and 71' are substituted for sealing members 72, 103 and 71, respectively. The only difference between the respective sealing members is that those shown in FIGS. 14, 15 and 16 have a straight edge for engagement with a straight wall. In contrast to this, the edges of sealing members 72', 103' and 71' are curved at **72*a*, 103*a* and 71*a* and this curvature is complementary to the curvature of wall 15. Thus, by interchanging sealing member 72', 103' and 71' for sealing member 72, 103, and 71, respectively, the spray housing 16** can be used to wash and clean curved walls.

It is estimated that cleaning of the walls of the tank depicted in FIG. 1 will take less than twenty man-hours of labor when using the apparatus of the present invention, and that the walls will be cleaned more thoroughly than can be achieved by the direct manual labor used previously.

While the spray housing and system of the present invention has been described relative to tank walls, it will be appreciated that it may also be used for any types of vertical walls.

It can thus be seen that the improved wall cleaning device of the present invention is manifestly capable of achieving the above enumerated objects and while preferred embodiments have been disclosed, it will be appreciated that the present invention is not limited thereto but may be otherwise embodied within the scope of the following claims.

What is claimed is:

1. A unit for cleaning a substantially even wall surface comprising a housing, an opening in said housing for placement in contiguous relationship to said wall surface, means in said housing for projecting high pressure water against the portion of said wall framed by said opening, means in communication with said housing for conducting water away from said housing, sealing means for physical engagement with said wall, and affixing means for affixing said sealing means on said housing substantially entirely around said opening to confine said water in said housing by preventing escape of water between the junction of said sealing means with said wall.

2. A wall cleaning unit as set forth in claim 1 wherein said sealing means comprise flexible elongated strip members, and wherein said affixing means comprise elongated rigid strip members for mounting said flexible elongated strip members on said housing.

3. A wall cleaning unit as set forth in claim 1 wherein said sealing means includes wiping means for wiping said wall after said opening has traversed said wall.

4. A wall cleaning unit as set forth in claim 3 including means for evacuating said housing to cause said sealing means to be drawn into engagement with said wall.

5. A wall cleaning unit as set forth in claim 4 wherein said means for projecting said high pressure water against said wall comprises a manifold including first and second vertically spaced portions, a plurality of first jet means on said first portion of said manifold and a plurality of second jet means on said second portion of said manifold.

6. A wall cleaning unit as set forth in claim 5 wherein said first portion of said manifold is located above said second portion of said manifold, divider means, and means mounting said divider means on said housing between said first and second portions of said manifold to prevent flow from said first portion of said manifold from interfering with impingement on said wall of water emanating from said second portion of said manifold.

7. A wall cleaning unit as set forth in claim 1 including means for evacuating said housing to cause said sealing means to be drawn into engagement with said wall.

8. A wall cleaning unit as set forth in claim 7 wherein said means for projecting said high pressure water against said wall comprises a manifold including first and second vertically spaced portions, a plurality of first jet means on said first portion of said manifold and a plurality of second jet means on said second portion of said manifold.

9. A wall cleaning unit as set forth in claim 8 wherein said first portion of said manifold is located above said second portion of said manifold, divider means, and means mounting said divider means on said housing between said first and second portions of said manifold to prevent flow from said first portion of said manifold from interfering with impingement on said wall of water emanating from said second portion of said manifold.

10. A wall cleaning unit as set forth in claim 1 including means attached to said housing for suspending said housing relative to said wall.

11. A wall cleaning unit as set forth in claim 1 wherein said means for projecting said high pressure water against said wall comprises a manifold including first and second vertically spaced portions, a plurality of first jet means on said first portion of said manifold and a plurality of second jet means on said second portion of said manifold.

12. A wall cleaning unit as set forth in claim 11 wherein said sealing means includes wiping means for wiping said wall after said opening has traversed said wall.

13. A wall cleaning unit as set forth in claim 12 wherein said first portion of said manifold is located above said second portion of said manifold, divider means, and means mounting said divider means on said housing between said first and second portions of said manifold to prevent flow from said first portion of said manifold from interfering with impingement on said wall of water emanating from said second portion of said manifold.

14. A wall cleaning unit as set forth in claim 11 wherein said first portion of said manifold is located above said second portion of said manifold, and wherein said first jet means are offset relative to said second jet means.

15. A wall cleaning unit as set forth in claim 11 including means for removably mounting said manifold in said housing.

16. A wall cleaning unit as set forth in claim 11 wherein said first portion of said manifold is located above said second portion of said manifold, divider means, and means mounting said divider means on said housing between said first and second portions of said manifold to prevent flow from said first portion of said manifold from interfering with impingement on said wall of water emanating from said second portion of said manifold.

17. A wall cleaning unit as set forth in claim 16 wherein said first jet means are offset relative to said second jet means.

18. A wall cleaning unit as set forth in claim 1 including guide means on said housing for determining the extent of contact between said sealing means and said wall.

19. A wall cleaning unit as set forth in claim 18 wherein said sealing means includes wiping means for wiping said wall after said opening has traversed said wall.

20. A wall cleaning unit as set forth in claim 19 including means for evacuating said housing to cause said sealing means to be drawn into engagement with said wall.

21. A wall cleaning unit as set forth in claim 20 wherein said means for projecting said high pressure water against said wall comprises a manifold including first and second vertically spaced portions, a plurality of first jet means on said first portion of said manifold and a plurality of second jet means on said second portion of said manifold.

22. A wall cleaning unit as set forth in claim 21 wherein said first portion of said manifold is located above said second portion of said manifold, divider means, and means mounting said divider means on said housing between said first and second portions of said manifold to prevent flow from said first portion of said manifold from interfering with impingement on said wall of water emanating from said second portion of said manifold.

23. A wall cleaning unit as set forth in claim 18 including means for evacuating said housing to cause said sealing means to be drawn into engagement with said wall.

24. A wall cleaning unit as set forth in claim 18 wherein said guide means comprise a plurality of wheels on said housing.

25. A unit for cleaning a substantially even wall surface comprising a housing, an opening in said housing for placement in contiguous relationship to a wall, means in said housing for projecting high pressure water aganist the portion of said wall framed by said opening, sealing means, affixing means for affixing said sealing means on said housing substantially entirely around said opening for physical engagement with said wall to prevent escape of water between the junction of said sealing means with said wall, and means for evacuating said housing to cause said sealing means to tend to be drawn into engagement with said wall.

26. A wall cleaning unit as set forth in claim 25 wherein said sealing means includes wiping means for wiping said wall after said opening has traversed said wall.

27. A wall cleaning unit comprising a housing, an opening in said housing for placement in contiguous relationship to said wall, means in said housing for projecting high pressure water against the portion of said wall framed by said opening, means in communication with said housing for conducting water away from said housing, and means for evacuating said housing to cause said housing to be drawn toward said wall, said means for evacuating said housing comprising high pressure water jets for directing high pressure water at said means for conducting water away from said housing.

28. A wall cleaning unit as set forth in claim 27 wherein said sealing means includes wiping means for wiping said wall after said opening has traversed said wall.

29. A wall cleaning unit as set forth in claim 28 wherein said means for projecting said high pressure water against said wall comprises a manifold including first and second vertically spaced portions, a plurality of first jet means on said first portion of said manifold and a plurality of second jet means on said second portion of said manifold.

30. A wall cleaning unit as set forth in claim 29 wherein said first portion of said manifold is located above said second portion of said manifold, divider means, and means mounting said divider means on said housing between said first and second portions of said manifold to prevent flow from said first portion of said manifold from interfering with impingement on said wall of water emanating from said second portion of said manifold.

* * * * *